US008636236B2

(12) United States Patent
Zhi

(10) Patent No.: US 8,636,236 B2
(45) Date of Patent: Jan. 28, 2014

(54) METHOD FOR PRODUCING PEARL POWDER THROUGH LEVIGATION AND ROLLING PORCELAIN BALLS

(75) Inventor: Jianhua Zhi, Wuxi (CN)

(73) Assignee: Wuxi Xishimei Daily Chemical Co., Ltd, Wuxi (CN)

( * ) Notice: Subject to any disclaimer, the term of this patent is extended or adjusted under 35 U.S.C. 154(b) by 184 days.

(21) Appl. No.: 13/368,262

(22) Filed: Feb. 7, 2012

(65) Prior Publication Data

US 2013/0068864 A1 Mar. 21, 2013

(30) Foreign Application Priority Data

Sep. 16, 2011 (CN) ..... 2011 1 0275485

(51) Int. Cl.
*B02C 25/00* (2006.01)
*B02C 21/00* (2006.01)

(52) U.S. Cl.
USPC ..... 241/23; 241/30

(58) Field of Classification Search
USPC ..... 241/23, 30
See application file for complete search history.

(56) References Cited

U.S. PATENT DOCUMENTS 8,485,458 B2 * 7/2013 Camprasse et al. ..... 241/23

* cited by examiner

*Primary Examiner* — Faye Francis
(74) *Attorney, Agent, or Firm* — Ivy Mei; The Law Office of Ivy Mei

(57) ABSTRACT

The present invention involves a method for producing pearl powder through levigation and rolling porcelain balls. The method the present invention prevents metal element from mixing into the pearl powder, thus ensuring the pure naturalness and medicinal value of the pearl powder.

3 Claims, 1 Drawing Sheet

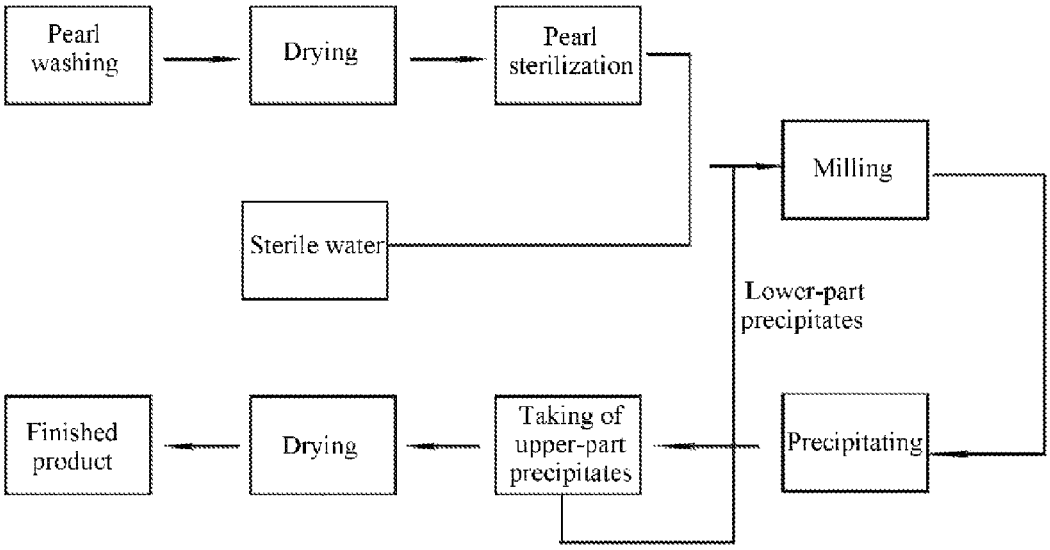
Pearl washing
Drying
Pearl sterilization
Milling
Sterile water
Lower-part precipitates
Finished product
Drying
Taking of upper-part precipitates
Precipitating

METHOD FOR PRODUCING PEARL POWDER THROUGH LEVIGATION AND ROLLING PORCELAIN BALLS

FIELD OF INVENTION

The present invention relates to the production of pearl powder, and more particularly, to a method for producing pearl powder through levigation and rolling porcelain balls.

BACKGROUND

There are various processes used in devices for producing pearl powder from natural freshwater pearls; and the quality of the pearl powder produced by such devices varies considerably. Regardless of the devices and processes used, the essence of such processes is using stainless steel grinding discs or porcelain grinding discs, driven by an electric motor with a high-speed rotation. Since the gap between grinding discs is small, high temperature occurs during the production process due to the high-speed of and the tight friction between the grinding discs. To produce the pearl powder in a small particle size, currently, the manufacturers decrease the gap between grinding discs. Although fine pearl powder is obtained, a temperature caused by the friction between the grinding discs increases, causing damage to the medical efficacy of the pearl powder. When the pearl powder is produced using the stainless steel grinding discs, stainless steel particles resulting from the grinding are more or less mixed into the pearl powder, which is likely to reduce the naturalness of the pearl powder and decrease the medical efficacy of the pearl powder.

SUMMARY OF THE INVENTION

An objective of the present invention is to overcome the limitations of the prior art. A method is provided for producing pearl powder through levigation, and rolling porcelain balls.

According to technical solutions of the present invention, the method for producing pearl powder through levigation and rolling porcelain balls is characterized by including the following process steps.

(1) Selection: select pearls having a diameter of 3.5~8.6 millimeters (mm).

(2) Washing: place pearls and clean water into a first washing porcelain jar at a mass ratio of 1~1.1:1.1, and then rotate the first washing porcelain jar tow ash the pearls for 5~5.1 minutes at the speed of 40~42 rpm (revolutions per minute), where the temperature of the clean water is 40~42° C.; then, move the pearls into a second washing porcelain jar, add detergent, and rotate the second washing porcelain jar to wash the pearls for 5~5.1 minutes at the speed of 40~42 rpm, where the mass ratio of pearls to detergent is 100~102:1~1.1; afterwards, move the pearls into a third washing porcelain jar, add purified water, and rotate the third washing porcelain jar to wash the pearls for 2~2.1 minutes at the speed of 40~42 rpm, where the mass ratio of pearls to purified water is 10~10.1:10~10.5; afterwards, move the pearls onto a porcelain plate having a bottom configured with small holes of a diameter of 3~3.2 mm, spray purified water on the pearls for 1~1.1 minutes at the rate of 10~10.2 kg/minute (kilogram per minute).

(3) Drying: place clean pearls into an oven to dry the pearls at a temperature of 80~82° C. for 40~60 minutes.

(4) Sterilization: process the dry pearls in an autoclave at a pressure of 0.1~0.15 MPa (megapascal) for 20~30 minutes to obtain sterilized pearls.

(5) Milling: place sterile water, sterilized pearls and sterilized porcelain balls into a sterilized milling porcelain jar at a mass ratio of 3~3.1:5~5.1:4~4.1, and rotate the milling porcelain jar at the speed of 70~80 rpm to cause the sterile water, the sterilized pearls and the sterilized porcelain balls to revolve within the milling porcelain jar and to mill the sterilized pearls for 240~242 hours to produce pearl emulsion.

(6) Pour the pearl emulsion obtained through step (5) into a sterilized container for precipitation for 28~30 hours, select the upper portion of the precipitates, and dry the selected portion of the precipitates for 1~1.2 hours at the temperature of 80~82° C. to obtain the pearl powder.

Electrical conductivity of the sterile water is less than 1. The diameters of the porcelain balls are 30~50 mm.

The present invention has the following advantages: (1) during the entire production process according to the present invention, the pearls do not contact metal, so that no metal element is mixed into the pearl powder, which preserves the pure naturalness of the pearl powder, and the inherent medicinal value of the pearl powder, and (2) the entire production process according to the present invention does not subject the pearls to high temperature, which ensures that natural medicinal ingredients of the pearl powder are not damaged.

BRIEF DESCRIPTION OF THE DRAWINGS

FIG. 1 is a flow chart of a process of the present invention.

DETAILED DESCRIPTION OF THE INVENTION

The present invention is further described in the following with reference to specific embodiments.

Disposed in the milling porcelain jar of the present invention are porcelain balls of different sizes with diameters in 30~50 mm. Driven by a transmission device, the entire milling porcelain jar is rotated to cause the porcelain balls to move irregularly in the milling porcelain jar. The pearls are smashed through such movement of the porcelain balls in the milling porcelain jar and finally milled into pearl powder.

The detergent used in the present invention may be a detergent adapted for washing fruits.

Embodiment 1: a method for producing pearl powder through levigation and rolling porcelain balls includes the following process steps.

(1) Selection: select three-year-old pearls having a diameter of 3.5 mm, where shriveled pearls, stone pearls and morbid pearls are discarded.

(2) Washing: place pearls and clean water into a first washing porcelain jar at a mass ratio of 1:1, and then rotate the first washing porcelain jar to wash the pearls for 5 minutes at the speed of 40 rpm, where the temperature of the clean water is 40° C.; then, move the pearls into a second washing porcelain jar, add detergent, and rotate the second washing porcelain jar to wash the pearls for 5 minutes at the speed of 40 rpm, where the mass ratio of pearls to detergent is 100:1, afterwards, move the pearls into a third washing porcelain jar, add purified water, and rotate the third washing porcelain jar to wash the pearls for 2 minutes at the speed of 40 rpm, where the mass ratio of pearls to purified water is 10:10; afterwards, move the pearls onto a porcelain plate having a bottom configured with small holes of a diameter of 3 mm, spray purified water on the pearls for 1 minute at the rate of 10 kg/minute.

(3) Drying: place clean pearls into an oven to dry the pearls at a temperature of 80° C. for 40 minutes.

(4) Sterilization: process the dry pearls in an autoclave at a pressure of 0.1 MPa for 20 minutes to obtain sterilized pearls.

(5) Milling: place sterile water, sterilized pearls and sterilized porcelain balls into a sterilized milling porcelain jar at a mass ratio of 3:5:4, and rotate the milling porcelain jar at the speed of 70 rpm to cause the sterile water, the sterilized pearls and the sterilized porcelain balls to revolve within the milling porcelain jar and to mill the sterilized pearls for 240 hours to produce pearl emulsion. Electrical conductivity of the sterile water is less than 1, and the diameter of the porcelain balls is 30 mm.

(6) Pour the pearl emulsion obtained through step (5) into a sterilized container for precipitation for 28 hours, select the upper portion of the precipitates, and dry the selected portion of the precipitates for 1 hours at the temperature of 80° C. to obtain the pearl powder, and the lower portion of the precipitates may be returned to the step (4) of the milling process for milling.

Embodiment 2: a method for producing pearl powder through levigation and rolling porcelain balls includes the following process steps.

(1) Selection: select four-year-old pearls having a diameter of 4.2 mm, where shriveled pearls, stone pearls and morbid pearls are discarded.

(2) Washing: place pearls and clean water into a first washing porcelain jar at a mass ratio of 1.1:1.1, and then rotate the first washing porcelain jar to wash the peals for 5.1 minutes at the speed of 42 rpm, where the temperature of the clean water is 42° C.; then, move the pearls into a second washing porcelain jar, add detergent, and rotate the second washing porcelain jar to wash the pearls for 5.1 minutes at the speed of 42 rpm, where the mass ratio of pearls to detergent is 102:1; afterwards, move the pearls into a third washing porcelain jar, add purified water, and rotate the third washing porcelain jar to wash the pearls for 2.1 minutes at the speed of 42 rpm; where the mass ratio of pearls to purified water is 10.1:10.5; afterwards, move the pearls onto a porcelain plate having a bottom configured with small holes of a diameter of 3.2 mm, spray purified water on the pearls for 1.1 minute at the rate of 10.2 kg/minute.

(3) Drying: place clean pearls into an oven to dry the pearls at a temperature of 82° C. for 60 minutes.

(4) Sterilization: process the dry pearls in an autoclave at a pressure of 0.15 MPa for 30 minutes to obtain sterilized pearls.

(5) Milling: place sterile water, sterilized pearls and sterilized porcelain balls into a sterilized milling porcelain jar at a mass ratio of 3.1:5.1:4.1, and rotate the milling porcelain jar at the speed of 80 rpm to cause the sterile water, the sterilized pearls and the sterilized porcelain balls to revolve within the milling porcelain jar and to mill the sterilized pearls for 242 hours to produce pearl emulsion. Electrical conductivity of the sterile water is less than 1, and the diameter of the porcelain balls is 30 mm.

(6) Pour the pearl emulsion obtained through step (5) into a sterilized container for precipitation for 30 hours, select the upper portion of the precipitates, and dry the selected portion of the precipitates for 1.2 hours at the temperature of 82° C. to obtain the pearl powder; and the lower portion of the precipitates may be returned to the step (4) of the milling process for milling.

Embodiment 3: a method for producing pearl powder through levigation and rolling porcelain balls includes the following process steps.

(1) Selection: select five-year-old pearls having a diameter of 5 mm, where shriveled pearls, stone pearls and morbid pearls are discarded.

(2) Washing: place pearls and clean water into a first washing porcelain jar at a mass ratio of 1:1, and then rotate the first washing porcelain jar to wash the pearls for 5 minutes at the speed of 41 rpm, where the temperature of the clean water is 41° C.; then, move, the pearls into a second washing porcelain jar, add detergent, and rotate the second washing porcelain jar to wash the pearls for 5 minutes at the speed of 41 rpm, where the mass ratio of pearls to detergent is 101:1; afterwards; move the pearls into a third washing porcelain jar, add purified water, and rotate the third washing porcelain jar to wash the pearls for 2 minutes at the speed of 41 rpm, where the mass ratio of pearls to purified water is 10:10.1; afterwards, move the pearls onto a porcelain plate having a bottom configured with small holes of a diameter of 3.1 mm, spray purified water on the pearls for 1 minute at the rate of 10.1 kg/minute.

(3) Drying: place clean pearls into an oven to dry the pearls at a temperature of 81° C. for 50 minutes.

(4) Sterilization: process the dry pearls in an autoclave at a pressure of 0.11 MPa for 25 minutes to obtain sterilized pearls.

(5) Milling: place sterile water, sterilized pearls and sterilized porcelain balls into a sterilized milling porcelain jar at a mass ratio of 3:5:4, and rotate the milling porcelain jar at the speed of 75 rpm to cause the sterile water, the sterilized pearls and the sterilized porcelain balls to revolve within the milling porcelain jar and to mill the sterilized pearls for 241 hours to produce pearl emulsion. Electrical conductivity of the sterile water is less than 1, and the diameter of the porcelain balls is 40 mm.

(6) Pour the pearl emulsion obtained through step (5) into a sterilized container for precipitation for 29 hours, select the upper portion of the precipitates, and dry the selected portion of the precipitates for 1.1 hours at the temperature of 81° C. to obtain the pearl powder, and the lower portion of the precipitates may be returned to the step (4) of the milling process for milling.

Embodiment 4: a method for producing pearl powder through levigation and rolling porcelain balls includes the following process steps.

(1) Selection: select six-year-old pearls having a diameter of 5.8 mm, where shriveled pearls, stone pearls and morbid pearls are discarded.

(2) Washing: place pearls and clean water into a first washing porcelain jar at a mass ratio of 1.1:1.1, and then rotate the first washing porcelain jar to wash the pearls for 5.1 minutes at the speed of 41 rpm, where the temperature of the clean water is 41° C.; then, move the pearls into a second washing porcelain jar, add detergent, and rotate the second washing porcelain jar to wash the pearls for 5.1 minutes at the speed of 41 rpm, where the mass ratio of pearls to detergent is 101:1; afterwards, move the pearls into a third washing porcelain jar, add purified water, and rotate the third washing porcelain jar to wash the pearls for 2.1 minutes at the speed of 41 rpm, where the mass ratio of pearls to purified water is 10:10.2; afterwards, move the pearls onto a porcelain plate having a bottom configured with small holes of a diameter of 3.1 mm, spray purified water on the pearls for 1.1 minute at the rate of 10.1 kg/minute.

(3) Drying: place clean pearls into an oven to dry the pearls at a temperature of 81° C. for 50 minutes.

(4) Sterilization: process the dry pearls in an autoclave at a pressure of 0.12 MPa for 25 minutes to obtain sterilized pearls.

(5) Milling: place sterile water, sterilized pearls and sterilized porcelain balls into a sterilized milling porcelain jar at a mass ratio of 3.1:5.1:4.1, and rotate the milling porcelain jar at the speed of 75 rpm to cause the sterile-water, the sterilized pearls and the sterilized porcelain balls to revolve within the milling porcelain jar and to mill the sterilized pearls for 241 hours to produce pearl emulsion. Electrical conductivity of the sterile water is less than 1, and the diameters of the porcelain balls are 30 mm, 40 mm.

(6) Pour the pearl emulsion obtained through step (5) into a sterilized container for precipitation for 29 hours, select the upper portion of the precipitates, and dry the selected portion of the precipitates for 1.1 hours at the temperature of 81° C. to obtain the pearl powder; and the lower portion of the precipitates may be returned to the step (4) of the milling process for milling.

Embodiment 5: a method for producing pearl powder through levigation and rolling porcelain balls includes the following process steps.

(1) Selection: select seven-year old pearls having a diameter of 6.7 mm, where shriveled pearls, stone pearls and morbid pearls are discarded.

(2) Washing: place pearls and clean water into a first washing porcelain jar at a mass ratio of 1:1.1, and then rotate the first washing porcelain jar to wash the pearls for 5 minutes at the speed of 41 rpm, where the temperature of the clean water is 42° C.; then, move the pearls into a second washing porcelain jar, add detergent, and rotate the second washing porcelain jar to wash the pearls for 5 minutes at the speed of 42 rpm, where the mass ratio of pearls to detergent is 100:1; afterwards, move the pearls into a third washing porcelain jar, add purified water, and rotate the third washing porcelain jar to wash the pearls for 2.1 minutes at the speed of 40 rpm, where the mass ratio of pearls to purified water is 10.1:10.3; afterwards, move the pearls onto a porcelain plate having a bottom configured with small holes of a diameter of 3 mm, spray purified water on the pearls for 1.1 minute at the rate of 10 kg/minute.

(3) Drying: place clean pearls into an oven to dry the pearls at a temperature of 82° C. for 45 minutes.

(4) Sterilization: process the dry pearls in an autoclave at a pressure of 0.13 MPa for 22 minutes to obtain sterilized pearls.

(5) Milling: place sterile water; sterilized pearls and sterilized porcelain balls into a sterilized milling porcelain jar at a mass ratio of 3:5.1:4, and rotate the milling porcelain jar at the speed of 72 rpm to cause the sterile water, the sterilized pearls and the sterilized porcelain balls to revolve within the milling porcelain jar and to mill the sterilized pearls for 241 hours to produce pearl emulsion. Electrical conductivity of the sterile water is less than 1, and the diameters of the porcelain balls are 30 mm, 40 mm, 50 mm.

(6) Pour the pearl emulsion obtained through step (5) into a sterilized container for precipitation for 28 hours, select the upper portion of the precipitates, and dry the selected portion of the precipitates for 1 hours at the temperature of 82° C. to obtain the pearl powder; and the lower portion of the precipitates may be returned to the step (4) of the milling process for milling.

Embodiment 6: a method for producing pearl powder through levigation and rolling porcelain balls includes the following process steps.

(1) Selection: select eight-year-old pearls having a diameter of 7.6 mm, where shriveled pearls, stone pearls and morbid pearls are discarded.

(2) Washing: place pearls and clean water into a first washing porcelain jar at a mass ratio of 1.1:1, and then rotate the first washing porcelain jar to wash the pearls for 5 minutes at the speed of 42 rpm, where the temperature of the clean water is 42° C.; then, move the pearls into a second washing porcelain jar, add detergent, and rotate the second washing porcelain jar to wash the pearls for 5 minutes at the speed of 42 rpm, where the mass ratio of pearls to detergent is 100.1:1; afterwards, move the pearls into a third washing porcelain jar, add purified water, and rotate the third washing porcelain jar to wash the pearls for 2.1 minutes at the speed of 40 rpm, where the mass ratio of pearls to purified water is 10:10.5; afterwards, move the pearls onto a porcelain plate having a bottom configured with small holes of a diameter of 3 mm, spray purified water on the pearls for 1.1 minute at the rate of 10 kg/minute.

(3) Drying: place clean pearls into an oven to dry the pearls at a temperature of 82° C. for 55 minutes.

(4) Sterilization: process the dry pearls in an autoclave at a pressure of 0.14 MPa for 24 minutes to obtain sterilized pearls.

(5) Milling: place sterile water, sterilized pearls and sterilized porcelain balls into a sterilized milling porcelain jar at a mass ratio of 3.1:5.1:4, and rotate the milling porcelain jar at the speed of 74 rpm to cause the sterile water, the sterilized pearls and the sterilized porcelain balls to revolve within the milling porcelain jar and to mill the sterilized pearls for 240.5 hours to produce pearl emulsion. Electrical conductivity of the sterile water is less than 1, and the diameters of the porcelain balls are 30 mm, 50 mm.

(6) Pour the pearl emulsion obtained through step (5) into a sterilized container for precipitation for 28 hours, select the upper portion of the precipitates, and dry the selected portion of the precipitates for 1.2 hours at the temperature of 82° C. to obtain the pearl powder; and the lower portion of the precipitates may be returned to the step (4) of the milling process for milling.

What is claimed is:

1. A method for producing pearl powder through levigation and rolling porcelain balls, characterized by including the following process steps:

(1) selecting pearls having a diameter of 3.5~8.6 millimeters (mm), (2) placing pearls and clean water into a first washing porcelain jar at a mass ratio of 1~1.1:1~1.1, rotating the first washing porcelain jar to wash the pearls for 5~5.1 minutes at the speed of 40~42 rpm (revolutions per minute), where the temperature of the clean water is 40~42° C.;

moving the pearls into a second washing porcelain jar, add detergent, and rotating the second washing porcelain jar to wash the pearls for 5~5.1 minutes at the speed of 40~42 rpm, where the mass ratio of pearls to detergent is 100~102:1~1.1;

afterwards, moving the pearls into a third washing porcelain jar, adding purified water, and rotating the third washing porcelain jar to wash the pearls for 2~2.1 minutes at the speed of 40~42 rpm, where the mass ratio of pearls to purified water is 10~10.1:10~10.5; afterwards, moving the pearls onto a porcelain plate having a bottom configured with small holes of a diameter of 3~3.2 mm, spray purified water on the pearls for 1~1.1 minutes at the rate of 10~10.2 kg/minute (kilogram per minute), (3) placing clean pearls into an oven to dry the pearls at a temperature of 80~82° C. for 40~60 minutes, (4) sterilizing by processing the dry pearls in an autoclave at a pressure of 0.1~0.15 MPa (megapascal) for 20~30 minutes to obtain sterilized pearls, (5) milling by place sterile water, sterilized pearls and sterilized porcelain balls into a sterilized milling porcelain jar at a mass ratio of 3~3.1:5~5.1:4~4.1, and rotating the milling porcelain jar at the speed of 70~80 rpm to cause the sterile water, the sterilized pearls and the sterilized porcelain balls to revolve within the milling porcelain jar and to mill the sterilized pearls for 240~242 hours to produce pearl emulsion, (6) pouring the pearl emulsion obtained through step (5) into a sterilized container for precipitation for 28~30 hours, selecting the upper portion of the precipitates, and drying the selected portion of the precipitates for 1~1.2 hours at the temperature of 80~82° C. to obtain the pearl powder.

2. The method of claim 1 for producing pearl powder through levigation and rolling porcelain balls, wherein electrical conductivity of the sterile water is less than 1.

3. The method of claim 1 for producing pearl powder through levigation and rolling porcelain balls, wherein a diameter of the porcelain balls is 30~50 mm.

* * * * *